United States Patent [19]

Scheithauer et al.

[11] Patent Number: 4,804,407

[45] Date of Patent: Feb. 14, 1989

[54] METHOD FOR RECOVERING COBALT FROM HEXAMMINE COBALTIC (111) SOLUTIONS

[75] Inventors: Richard A. Scheithauer; Clarence D. Vanderpool; Michael J. Miller, all of Towanda, Pa.

[73] Assignee: GTE Products Corporation, Stamford, Conn.

[21] Appl. No.: 194,647

[22] Filed: May 13, 1988

[51] Int. Cl.[4] ..... B22F 9/24

[52] U.S. Cl. ..... 75/0.5 AA; 75/108; 75/109; 75/119

[58] Field of Search ..... 75/0.5 AA, 108, 109, 75/119

[56] References Cited

U.S. PATENT DOCUMENTS

| | | | |
|---|---|---|---|
| 4,093,450 | 6/1978 | Doyle et al. | 75/0.5 AA |
| 4,184,868 | 1/1980 | Ritsko et al. | 75/0.5 AA |
| 4,214,894 | 7/1980 | Ritsko et al. | 75/0.5 AA |
| 4,214,895 | 7/1980 | Gingerich et al. | 75/0.5 AA |
| 4,214,896 | 7/1980 | Cheresnowsky et al. | 75/0.5 AA |
| 4,218,240 | 5/1979 | Gingerich et al. | 75/0.5 AA |
| 4,233,063 | 11/1980 | Ritsko et al. | 75/0.5 AA |
| 4,278,463 | 7/1981 | Vanderpool et al. | 75/0.5 A |
| 4,329,169 | 5/1982 | Gingerich | 75/0.5 AA |
| 4,348,224 | 9/1980 | Gingerich et al. | 75/0.5 AA |
| 4,381,937 | 5/1983 | Gingerich et al. | 75/0.5 AA |
| 4,395,278 | 7/1983 | Vanderpool et al. | 75/0.5 AA |
| 4,409,019 | 10/1983 | Vanderpool et al. | 75/0.5 AA |
| 4,452,633 | 6/1984 | Miller et al. | 75/0.5 A |
| 4,469,505 | 9/1984 | Cheresnowsky et al. | 75/0.5 AA |
| 4,578,251 | 4/1988 | Ritsko et al. | 423/55 |
| 4,594,230 | 6/1986 | Scheithauer et al. | 423/140 |
| 4,606,885 | 8/1986 | Miller et al. | 419/39 |
| 4,608,084 | 8/1986 | Scheithauer et al. | 75/101 R |
| 4,608,235 | 8/1986 | Vanderpool et al. | 423/53 |
| 4,612,039 | 9/1986 | Scheithauer et al. | 75/0.5 AA |
| 4,690,710 | 9/1987 | Scheithauer et al. | 75/0.5 AA |

*Primary Examiner*—Wayland Stallard

*Attorney, Agent, or Firm*—Donald R. Castle; L. Rita Quatrini

[57] ABSTRACT

A method is disclosed for recovering cobalt, which comprises adding ammonia to a cobalt chloride solution to a pH of from about 8.8 to about 9.6 with oxidation, to form hexammine cobalt (III) chloride, adding to the resulting solution of hexammine cobalt (III) chloride, sodium chloride in an amount sufficient to result in the precipitation of at least about 98% by weight of the cobalt as cobalt hexammine (III) chloride at a temperature of no greater than about 40° C., separating the precipitate of cobalt hexammine (III) chloride from the resulting mother liquor which contains the balance of the cobalt, adding to the mother liquor, aluminum powder in an amount sufficient to result in the precipitation of the balance of the cobalt as cobalt metal, and separating the cobalt metal from the resulting spent liquor.

1 Claim, No Drawings

METHOD FOR RECOVERING COBALT FROM HEXAMMINE COBALTIC (111) SOLUTIONS

This invention relates to a method for recovering cobalt from solutions of cobalt hexammine (III) ion as a precipitate of cobalt hexammine (III) chloride. By the method of the present invention, the amount of hydrochloric acid and ammonia is reduced from the amount used in previous methods. The mother liquor from the precipitation of the hexammine is then treated with aluminum metal to cement the cobalt contained therein.

BACKGROUND OF THE INVENTION

Oxidation of cobaltous chloride ion to the cobaltic ammine ion is accomplished in an ammoniacal-ammonium chloride solution in the presence of an activated charcoal catalyst. The reaction mixture is essentially buffered at a pH of from about 9.0 to about 9.4. After a period of aeration, >98% by weight of the Co ions have been oxidized to $Co(NH_3)_6^{3+}$. Much of the Co at this point precipitates as $[Co(NH_3)_6]Cl_3$ due to the initial high concentration of chloride ion. However, in order to recover >98% by weight of the cobalt as the solid ammine complex additional chloride ion must be added to the mixture. At the present time, HCl is used as the source of chloride ion. This is described in U.S. Pat. No. 4,612,039. Hydrochloric acid is added to a pH of about 0.5 at which >98% by weight of the cobalt can be recovered by way of filtration. (The solid hexammine compound is further processed to extra fine cobalt metal powder.) The mother liquor from this filtration can contain up to about 5% of the initial cobalt (although generally about 2% or less) and, therefore, is treated in a separate step to recover the cobalt. This is accomplished by raising the pH to 8.0 to 8.5 with $NH_4OH$ and then cementing the cobalt out of solution with aluminum metal powder. After the cobalt is removed, the liquor is sent to a steam stripper for ammonia recovery. The recovered cobalt is then redigested in HCl and recycled to the beginning of the process. In the above process, much acid and ammonia are consumed. This results in high cost for materials and for extra processing.

Therefore, a process in which less acid and ammonia are used would be advantageous both from an economical and an environmental standpoint.

The following U.S. Patents relate to cobalt processing:

U.S. Pat. No. 4,184,868 relates to a method for producing extra fine cobalt metal powder by digesting cobalt pentammine chloride in ammonium hydroxide to obtain a black precipitate which contains cobalt and which is thereafter reduced to metal powder. U.S. Pat. Nos. 4,214,894, 4,214,896, 4,233,063, and 4,278,463 relate to improvements in U.S. Pat. No. 4,184,868 in which the ammonia solutions are processed to recover any cobalt therein. U.S. Pat. Nos. 4,395,278 and 4,469,505 relate to improvements in U.S. Pat. No. 4,184,868 in which fine cobalt metal powder is 10 produced having reduced tailings.

U.S. Pat. No. 4,214,895 relates to a process for producing cobalt metal powder which involves treating an aqueous solution of a soluble cobaltic ammine halide with a sufficient amount of a soluble metallic hydroxide to form a cobalt containing precipitate which is thereafter reduced to metallic cobalt.

U.S. Pat. Nos. 4,218,240 and 4,690,710 relate to methods for producing cobalt metal powder by forming a solution of a cobalt hexammine compound and treating the solution with a metallic hydroxide to form a precipitate which is reduced to cobalt metal powder. U.S. Pat. Nos. 4,348,224 and 4,381,937 relate to improvements in the process described in U.S. Pat. No. 4,218,240 which involve removal of copper and silver from the cobalt. U.S. Pat. No. 4,452,633 relates to an improvement in the processes described in U.S. Pat. Nos. 4,218,240 and 4,348,224 in which the silver is recovered.

U.S. Pat. No. 4,612,039 relates to a process for recovering cobalt in which cobalt is first reduced to the metal followed by ammonia-ammonium chloride digestion to form an hexammine cobalt (III) chloride while hydrochloric acid is added to precipitate the hexammine cobalt (III) chloride. The mother liquor is therefore acid and ammonium hydroxide is required to raise the pH to further recover any cobalt which remains in the mother liquor.

U.S. Pat. Nos. 4,608,084 and 4,608,235 relate to processes for recovering cobalt from stellite material.

U.S. Pat. No. 4,606,885 relates to producing a pure cobalt article.

U.S. Pat. No. 4,594,230 relates to a process for recovering cobalt from cobalt material by digestion in hydrochloric acid followed by precipitation of cobalt oxalate.

U.S. Pat. No. 4,578,251 relates to a process for separating chrominum from cobalt.

U.S. Pat. No. 4,093,450 to Doyle et al describes a process for producing fine particle size cobalt metal powder by the hydrogen reduction of cobalt oxide obtained from a cobalt pentammine carbonate solution. The precipitate is formed by heating the solution to drive off ammonia and carbon dioxide to form a precipitate of cobalt oxide.

U.S. Pat. No. 4,329,169 relates to a process for producing fine cobalt metal powder absent tailings by heating an aqueous solution of soluble cobalt ammine halide to decompose the halide and form a cobalt containing precipitate which is reduced to the cobalt metal powder.

U.S. Pat. No. 4,409,019 relates to a process for producing fine cobalt metal powder from pieces of relatively pure cobalt by dissolving the cobalt pieces in an aqueous solution of hydrogen iodide and iodine and forming a cobalt containing solid which is subsequently reduced to a fine cobalt metal powder.

SUMMARY OF THE INVENTION

In accordance with one aspect of this invention, there is provided a method for recovering cobalt, which comprises adding ammonia to a cobalt chloride solution to a pH of from about 8.8 to about 9.6 with oxidation to form hexammine cobalt (III) chloride, adding to the resulting solution of hexammine cobalt (III) chloride, sodium chloride in an amount sufficient to result in the precipitation of at least about 98% by weight of the cobalt as hexammine cobalt (III) chloride at a temperature of no greater than about 40° C., separating the precipitate of hexammine cobalt (III) chloride from the resulting mother liquor which contains the balance of the cobalt, adding to the mother liquor, aluminum powder in an amount sufficient to result in the precipitation of the balance of the cobalt as cobalt metal, and separating the cobalt metal from the resulting spent liquor.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

This invention relates to a process for recovering cobalt from solutions in which cobalt is present as cobaltic hexammine (III) ion. This is done by adding sufficient chloride ion in the form of sodium chloride to insure the precipitation of at least about 98% by weight of the cobalt contained therein. The balance of the cobalt is recovered by adding aluminum metal to the mother liquor to result in the formation of cobalt metal. The cobalt hexammine (III) chloride is then processed by existing methods to cobalt metal powder. The formation of the cobalt (III) hexammine is accomplished without hydrochloric acid as has been done prior to this invention as described in U.S. Pat. No. 4,612,039. This is advantageous both economically and environmentally because the acid does not have to be removed. This would be done by neutralizing with ammonia. The mother liquor from the precipitation is treated with aluminum metal to recover the balance of the cobalt by cementation. As a result of not using HCl in the formation of the hexammine, there is less volume of mother liquor and the mother liquor is at the desired pH for the cementation. Therefore less processing is required to recover the balance of the cobalt.

The starting cobalt solution is a solution of cobalt chloride having a cobalt concentration of typically from about 50 to about 120 g Co/l. Ammonia is added usually in the form of ammonium hydroxide to a pH of from about 8.8 to about 9.6 to form hexammine cobalt (III) chloride. This is done with oxidation which is usually air oxidation. Activated charcoal is present as a catalyst. The solution is kept at room temperature, that is less than about 40° C. and most typically about 20° C. for the subsequent precipitation.

To the resulting hexammine cobalt (III) chloride solution is added sodium chloride in an amount sufficient to result in the precipitation of at least about 98% by weight of the cobalt contained therein as hexammine cobalt (III) chloride. The sodium chloride is added preferably in the solid form to maintain the solution concentration of cobalt. The balance of the cobalt remains in the resulting mother liquof.

The precipitate is then separated from the mother liquor by any standard technique such as filtration.

The precipitate of hexammine cobalt (III) chloride can then be processed by existing technology to the metal powder.

To the mother liquor is added aluminum metal typically in powder form in an amount sufficient to result in the precipitation of the balance of the cobalt as cobalt metal. This process is known as the cementation of cobalt. In this step, there is no required pH adjustment with ammonia. The liquor is already at the desired pH whereas is HCl were used in the hexammine formation step, pH adjustment would be necessary. Also the volume of mother liquor to be treated with alumina is less than if HCl were used and this results in a simpler handling.

The cobalt metal is then separated form the cobalt depleted mother liquor by standard techniques such as filtration.

The recovered cobalt metal can then be further processed if necessary according to known methods depending on the desired use.

To more fully illustrate this invention, the following non-limiting example is presented.

EXAMPLE

Five tests are run in which the effect of adding HCl or NaCl at the end of the oxidation are compared. Oxidation conditions are identical in all five tests. Only the amounts of HCl or NaCl which are added to precipitate the hexammine cobalt (III) chloride are varied. The initial cobalt chloride solution contains about 110 g Co/l, about 28 g Ni/l, about 8.6 g Fe/l, about 41 g $NH_3$/l, and about 310 g $Cl^-$/l. These tests are shown below in the Table.

TABLE

| Test # | Chloride ion Added | Chloride ion Moles | Vol. ml | pH | Mother liquor g/l Co | Ni | Fe | Cl− |
|---|---|---|---|---|---|---|---|---|
| 1 | None | 0 | 410 | 9.4 | 3.3 | 12 | <0.005 | 52 |
| 2 | 110 ml HCl(*) | 1.3 | 700 | 0.5 | 1.2 | 8 | 2.2 | 91 |
| 3 | 29.2 g NaCl | 0.5 | 520 | 9.3 | 1.7 | 9 | <0.005 | 73 |
| 4 | 43.8 g NaCl | 0.75 | 420 | 9.4 | 0.8 | 9 | <0.005 | 110 |
| 5 | 58.4 g NaCl | 1.0 | 400 | 9.2 | 0.6 | 12 | <0.005 | 130 |

(*)to pH 0.5

The amount of chloride ion needed to substantially precipitate hexammine cobalt (III) chloride with NaCl is about half the amount needed using HCl where the pH is adjusted to about 0.5. See tests 1 and 2. Treatment of the resulting mother liquors from Tests 3, 4, and 5 can be accomplished simply by adding Aluminum powder to cement the cobalt. The volume decreases in the mother liquor when NaCl is used as opposed to HCl by about 25–40%. See Tests 2 and 4.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for recovering cobalt, said method comprising:

(a) adding ammonia to a cobalt chloride solution to a pH of from about 8.8 to about 9.6 with oxidation to form hexammine cobalt (III) chloride;

(b) adding to the resulting solution of hexammine cobalt (III) chloride, sodium chloride in an amount sufficient to result in the precipitation of at least about 98% by weight of the cobalt as hexammine cobalt (III) chloride at a temperature of no greater than about 40° C.;

(c) separating the precipitate of hexammine cobalt (III) chloride from the resulting mother liquor which contains the balance of the cobalt;

(d) adding to said mother liquor aluminum powder in an amount sufficient to result in the precipitation of said balance of cobalt as cobalt metal; and (e) separating said cobalt metal from the resulting spent liquor.

* * * * *